US005176080A

United States Patent [19]

Gasparrini et al.

[11] Patent Number: 5,176,080

[45] Date of Patent: Jan. 5, 1993

[54] CLOTH SUPPLY SYSTEM FOR BLANKET CYLINDER FOR USE IN PRINTING PRESSES

[75] Inventors: Charles R. Gasparrini, Portchester, N.Y.; Carl Arnolds, Stamford, Conn.

[73] Assignee: Baldwin Technology Corporation, Stamford, Conn.

[21] Appl. No.: 585,398

[22] Filed: Sep. 20, 1990

[51] Int. Cl.[5] ..... B41F 35/06; B65H 23/08

[52] U.S. Cl. ..... 101/425; 242/75.4

[58] Field of Search ..... 101/423, 425; 15/256.51; 226/195; 242/75.4, 75.41; 400/660

[56] References Cited

U.S. PATENT DOCUMENTS

| | | | |
|---|---|---|---|
| 1,198,097 | 9/1916 | Barnaby | 400/660 |
| 2,525,982 | 10/1950 | Wescott | 101/425 |
| 3,615,397 | 10/1971 | Dimond et al. | 101/425 |
| 4,058,059 | 11/1977 | Moestue | 101/425 |
| 4,344,361 | 8/1982 | MacPhee | 101/425 |
| 4,915,319 | 4/1990 | Gerber | 242/75.4 |
| 4,986,182 | 1/1991 | Sawaguchi et al. | 101/425 |

FOREIGN PATENT DOCUMENTS

| | | |
|---|---|---|
| 315144 | 5/1989 | European Pat. Off. . |
| 2636268 | 3/1990 | France . |

*Primary Examiner*—Clifford D. Crowder
*Assistant Examiner*—Stephen R. Funk
*Attorney, Agent, or Firm*—Morgan & Finnegan

[57] ABSTRACT

A cloth roll and mechanism for supporting and controlling feeding of the cloth from the cloth roll for cleaning a blanket cylinder of a lithographic press.

13 Claims, 6 Drawing Sheets

CLOTH SUPPLY SYSTEM FOR BLANKET CYLINDER FOR USE IN PRINTING PRESSES

FIELD OF THE INVENTION

This invention relates to a blanket cylinder cleaner and more particularly to a cloth supply system for use in connection with cleaning of blanket cylinders used in lithographic presses.

BACKGROUND OF THE INVENTION

Blanket cylinders used in lithographic presses can be cleaned in a variety of ways such as by stationary and/or rotating brushes or by use of cloth wound on a cloth supply roll which is unwound from the cloth supply roll by a take-up roll wherein the cloth is engaged with the blanket cylinder located between the cloth supply and take-up rollers. For a general description of an automatic blanket cylinder reference is made to MacPhee et al U.S. Pat. No. 4,344,361 issued Aug. 17, 1982 which is incorporated herein by reference. The present invention relates to an improvement thereof.

BACKGROUND OF PRIOR ART

Typically, according to prior art practices, the cloth is supplied on an inner cardboard core, wherein the inner cardboard core had a longitudinal length which is equal to the width of the cloth wound on the inner core. In order to rotatably mount the cloth roll another mechanism must be used which includes a support mechanism. For example, a metal shaft such as steel was inserted within the inner core which had an angled jaw-like structure adapted to move radially outwardly so as to engage the inner surface of the inner paperboard or cardboard core. In this fashion the metal shaft and the inner core would become integral so that movement of the metal shaft would result in movement of the inner cardboard liner as well as the fabric wound on the inner cardboard core. In addition, the metal shaft member was also used to mount the cloth roll for rotation.

It is necessary in unwinding the cloth for cleaning purposes, which is usually done in an intermittent fashion, that the cloth be controlled and/or restrained so as to prevent bunching of the cloth sometimes referred to in the art as "bagging". For this purpose, the prior art utilized a brake system at one end of the cloth roll which included a disk brake, leaf springs and the like to control the feed of the cloth. While the disk brake system assembly has been used satisfactorily for many years, this structure due to its number of parts and relative complexity was subject to certain operational difficulties.

At the opposite end of the cloth supply cylinder the metal shaft was provided with a sized plug which fit within a slot in the adjacent frame. In order to close the slot to prevent accidental displacement of the cleaning roll shaft during use a variety of means were used such as movable metal pins which closed the slot and prevented easy removal of the cloth assembly.

The prior art practices showed there was a need for an effective way of preventing loosening in the cleaning cloth fabric.

There were certain disadvantages of such prior art cloth roll assemblies. For example, the use of a metal insert shaft unit within the cardboard cylinder required the use of additional parts including a metal shaft and a plurality of jaw-like elements to engage the cardboard cylinder as well as a sized enlarged head at the other end to position the cloth assembly in a horizontal position. This added to the cost of the cleaning device. The metal shaft is not only an additional structure but it made replacement of a cloth roll assembly upon depletion of the cloth a relatively complicated procedure. In other words, when it was necessary to replace the cloth roll assembly the metal shaft member had to first be removed from the press. Next it was necessary to remove the metal shaft from the cloth assembly so that the used cloth roll core could be discarded so that the metal shaft unit could be reused.

In short, there was a need for a simplified cloth roll supply which can be quickly and expeditiously assembled and disassembled to the press and a need for controlling the feed of the cloth to prevent unravelling of the cleaning cloth.

OBJECTS OF THE INVENTION

With the foregoing in mind, it is an object of the invention to provide a new and improved cloth assembly system for use in a cleaning mechanism for a blanket cleaner on lithographic presses.

Another object of the invention is to provide a cloth roll assembly which can be assembled to the printing press without the need of additional parts to connect the cloth assembly to the press.

A further object of the invention is to provide a cloth assembly which can be quickly assembled and/or disassembled from the printing press.

A further object of the invention is to provide a cloth assembly which can be used or supplied and can be quickly assembled and/or disassembled from the printing press without the use of additional parts or adapters.

A further object of the invention is to provide a new and improved cloth assembly which can be assembled to the press with a snap action.

Another object of the invention is to provide a new and improved and simplified brake system for restraining movement to the fabric during the step of feeding the cloth towards the blanket roll cleaning position.

Another object of the invention is to provide a simplified means for constraining the cloth during the cloth takeoff step to prevent bunching, bagging or sagging of the cloth.

A still further object of the invention is to provide a new and novel cloth roll in combination with a cloth roll assembly means in the press.

Another object of the invention is to provide a new cloth roll system and assembly for use in lithographic presses.

Additional objects and advantages of the invention will be set forth in the description which follows and, in part will be obvious from the description. The objects and advantages being realized and obtained by means of the instrumentation, parts, methods and assemblies and apparatus particularly pointed out in the appended claims.

SUMMARY OF THE INVENTION

This invention is particularly directed to a new and useful cloth roll and mechanism for supporting and controlling feeding of cloth from the cloth roll. The cloth roll and its mounting is simplified so that the cloth roll can be used in the form supplied by the cloth supplier and can be inserted in position adjacent to the blanket cylinder quickly and expeditiously. Similarly, when the cloth roll has been expended the old cloth roll can be removed and a new cloth roll provided simply and expeditiously in a time saving and expeditious manner that is labor saving and cost effective. When in use the cloth roll is controlled in a manner which prevents excess cloth from feeding towards the take-up roll.

As used herein term "cloth" refers, to fabric which is typically used for cleaning a blanket cylinder as described in U.S. Pat. No. 4,344,361 and also refers to specifically formulated paper products which can be used for this purpose.

DETAILED DESCRIPTION OF THE INVENTION

Figure 1:
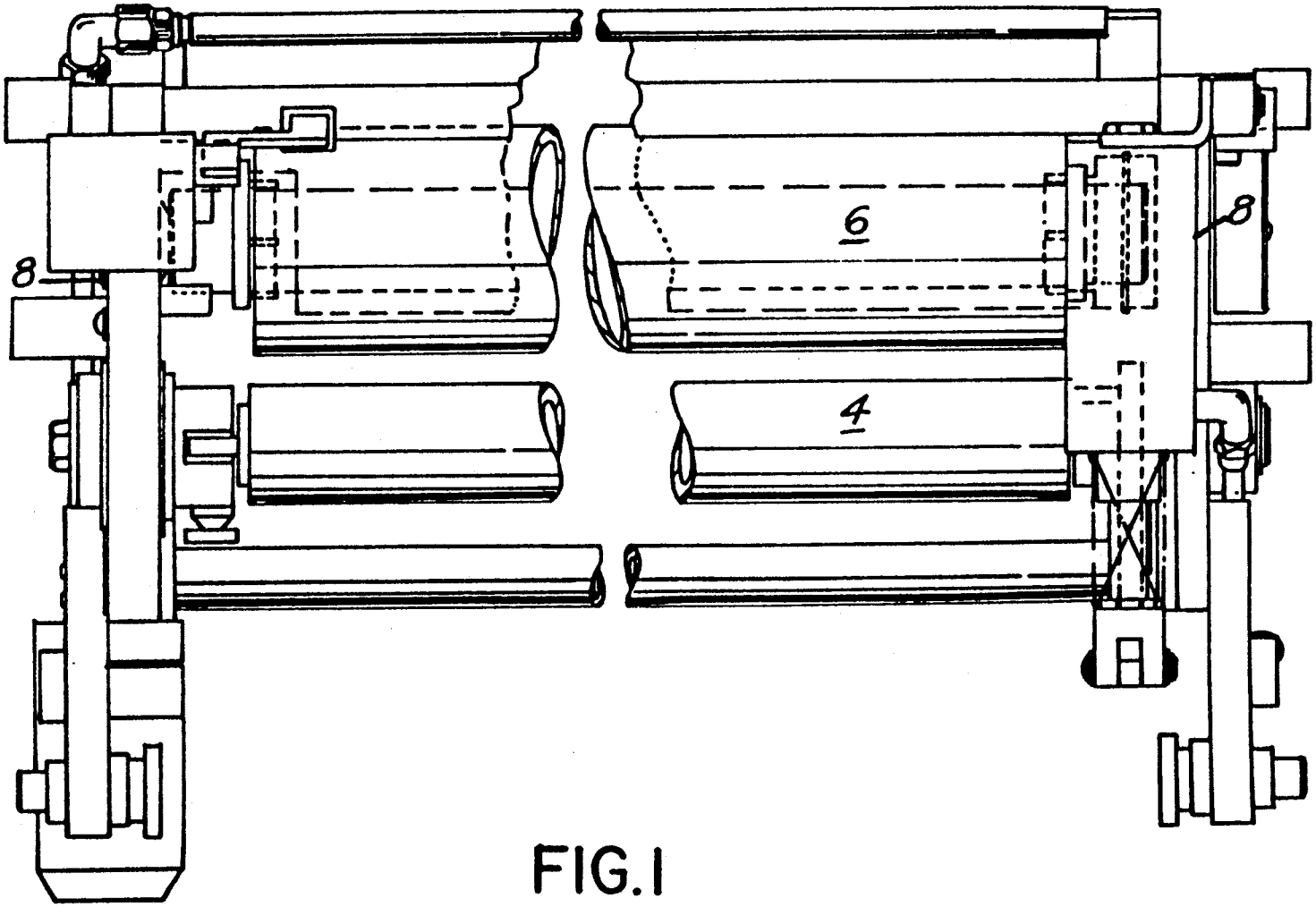
FIG. 1 is a front view of the blanket cleaner assembly in accordance with the invention.

Briefly described, the present invention includes a unique supply roll of fabric which can be conveniently made by the cloth roll supplier and used in the form supplied without the need for additional parts as part of the supply roll for supporting purposes. As embodied, the cloth or fabric is wound on a hollow cylinder member which may be made of paperboard or cardboard. The cardboard core has sufficient thickness to support the cloth even during use. The core has a length which is longer than the width of the cloth so that the ends of the core extend beyond the width of the fabric and can be used to support the cleaning cloth roll during the cleaning operation.

The cloth supply roll cooperates with a cloth take-up roll in the manner described in the MacPhee et al U.S. Pat. No. 4,344,361. Similarly, the cloth supply roll is adapted to cooperate with a water supply means and a hydrocarbon solvent supply means as desired. The cloth is adapted to clean a blanket cylinder by a bladder means as described in U.S. Pat. No. 4,344,361.

The cloth supply roll is adapted to be mounted on the press in an expeditious fashion which permits easy removability when the cloth supply is depleted and easy and simple insertion of a fresh cloth supply.

The assembly of the cloth supply roll to the press is accomplished in a preferred embodiment by a support structure including at least two stationary abutments on the stationary frame which, may be in the form of pins. Also there is a movable pin which can be moved out of the way for assembly and disassembly purposes and is resiliently urged in a locking position while the cloth roll is in operation. The invention further includes control means for restraining the cloth against movement or which constrains or supplies tension to the cloth in combination with means for applying friction to the core of the fabric supply roll while the cloth is being advanced. The spring means returns loose cloth to the cloth roll supply.

The invention consists of the novel parts, steps, construction and improvements shown and described.

The accompanying drawings consist of the novel parts, steps, construction and improvements shown and described.

The accompanying drawings which are incorporated in and constitute part of this specification illustrate an embodiment of the invention and together with the description serve to explain the principles of the invention.

The present invention is used in connection with a blanket cylinder (shown in U.S. Pat. No. 4,344,361), a cloth take-up roll 4 and a cloth supply roll 6 which can be suitably mounted in parallel relationship between a stationary frame such as side frame 8. The cloth used with the invention can be of the conventional type such as described in U.S. Pat. No. 4,344,361 which is incorporated herein by reference.

In accordance with their invention the cleaning "cloth" or fabric may also be made of paper having the following characteristics.

| | |
|---|---|
| BASIC WEIGHT | 63# |
| TEAR-MACHINE DIRECTION | 120 GRAMS OF RESISTANCE |
| TEAR-CROSS DIRECTION | 140 GRAMS OF RESISTANCE |
| DRY TENSILE-MACHINE DIRECTION | 30 POUNDS PER INCH |
| DRY TENSILE-CROSS DIRECTION | 20 POUNDS PER INCH |
| WET TENSILE-MACHINE DIRECTION | 36.7 UNAGED POUNDS PER INCH |
| WET TENSILE-CROSS DIRECTION | 10.0 AGED POUNDS PER INCH |
| POROSITY PER 1000 CC | 8 SECONDS |
| WET STRENGTH PAREZ 631 AND KYMENE. | |

Figure 3:
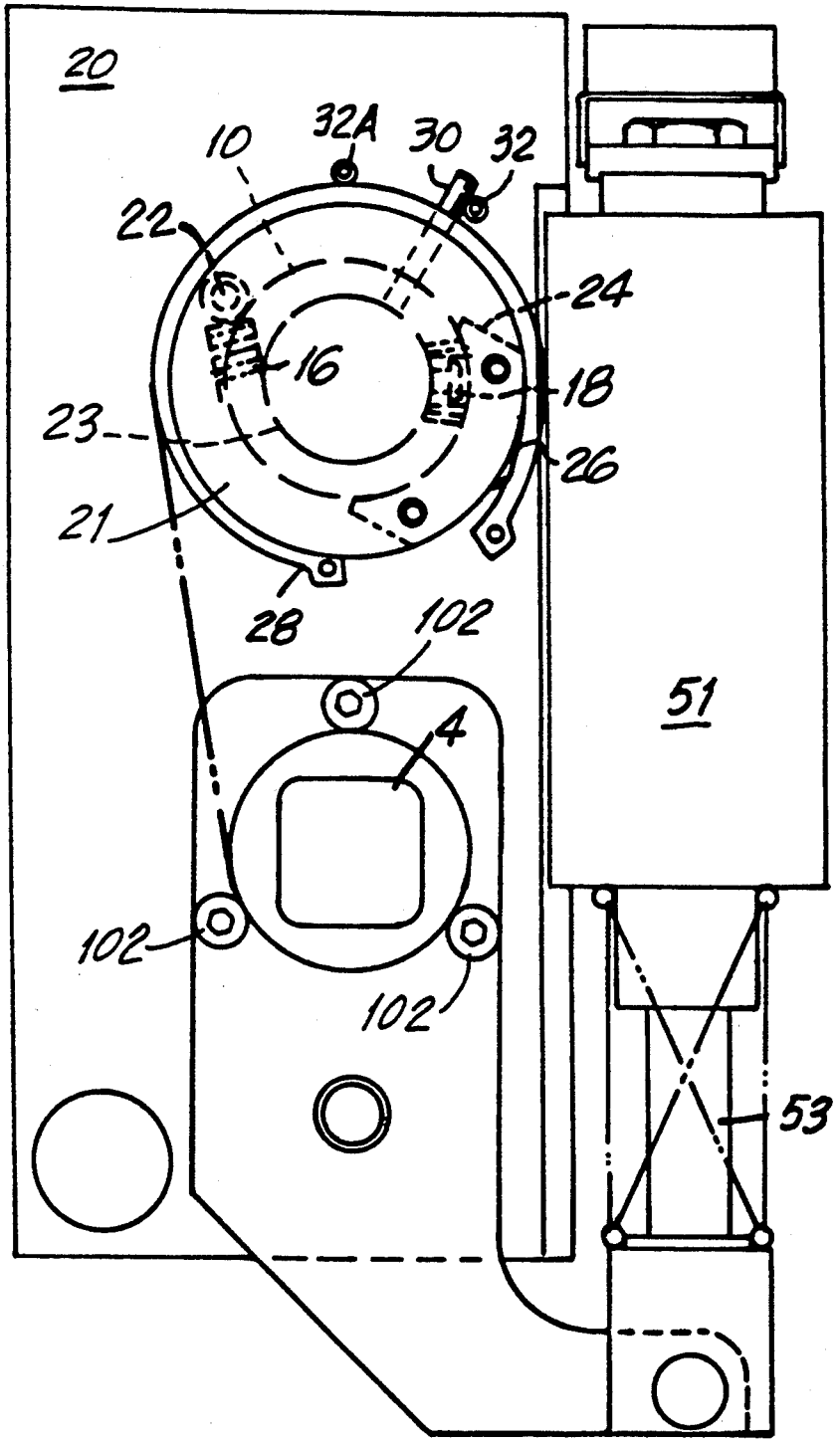
FIG. 3 is an elevation view of a portion of the invention.
Figure 5:
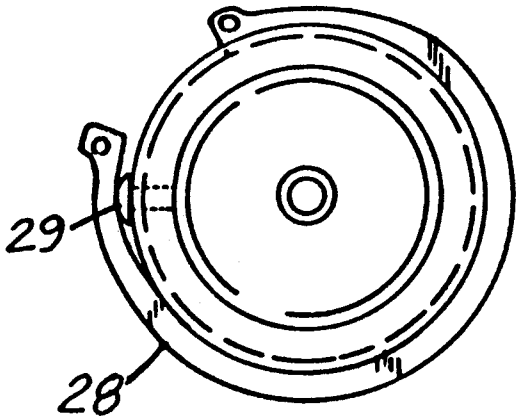
FIG. 5 is an elevation view of a portion of the invention.

Intermediate the cloth supply roll and the take-up roll there are means for causing the cloth to selectively engage the blanket cylinder for the purpose of cleaning the blanket cylinder. The mechanism used to selectively engage the blanket cylinder can be any conventional means such as the bladder means shown and described in U.S. Pat. No. 4,344,361. The invention is intended to be used with a mechanism for incrementally advancing the cleaning cloth from the cloth supply roll to the take-up roll. As shown in FIG. 3, the advancing means for advancing the cloth from the cloth supply roll to the take-up roll is illustrated in part by the cylinder 51 and its associated piston 53. A more detailed description thereof can be found in U.S. Pat. No. 4,344,361. It is understood, however, that the invention herein is not limited to the particular advancing mechanism disclosed in that patent and that the present invention can be used with other and different advancing mechanisms.

In accordance with the invention means is provided which eliminates the need for an adaptor such as a metal core to be used in conjunction with the cloth roll.

In accordance with many prior art practices, the cloth roll is provided where there is an inner cardboard core which has the same length or the width of the paper wound on the core. In such instances, the core ends were flush with the ends of the width of the cloth wound on the core. In such instances, it is necessary to use an adaptor such as a metal shaft having, at one end, a radially angled jaws adapted to engage the inner surface of the cardboard core at the other end, an enlarged head, adapted to fit within a slot like structure to permit rotational movement of the shaft during the feeding operation.

In accordance with this invention means is provided for permitting the cloth roll to be used in the condition received from the cloth roll supplier so that an adaptor insert is not necessary.

Figure 2:
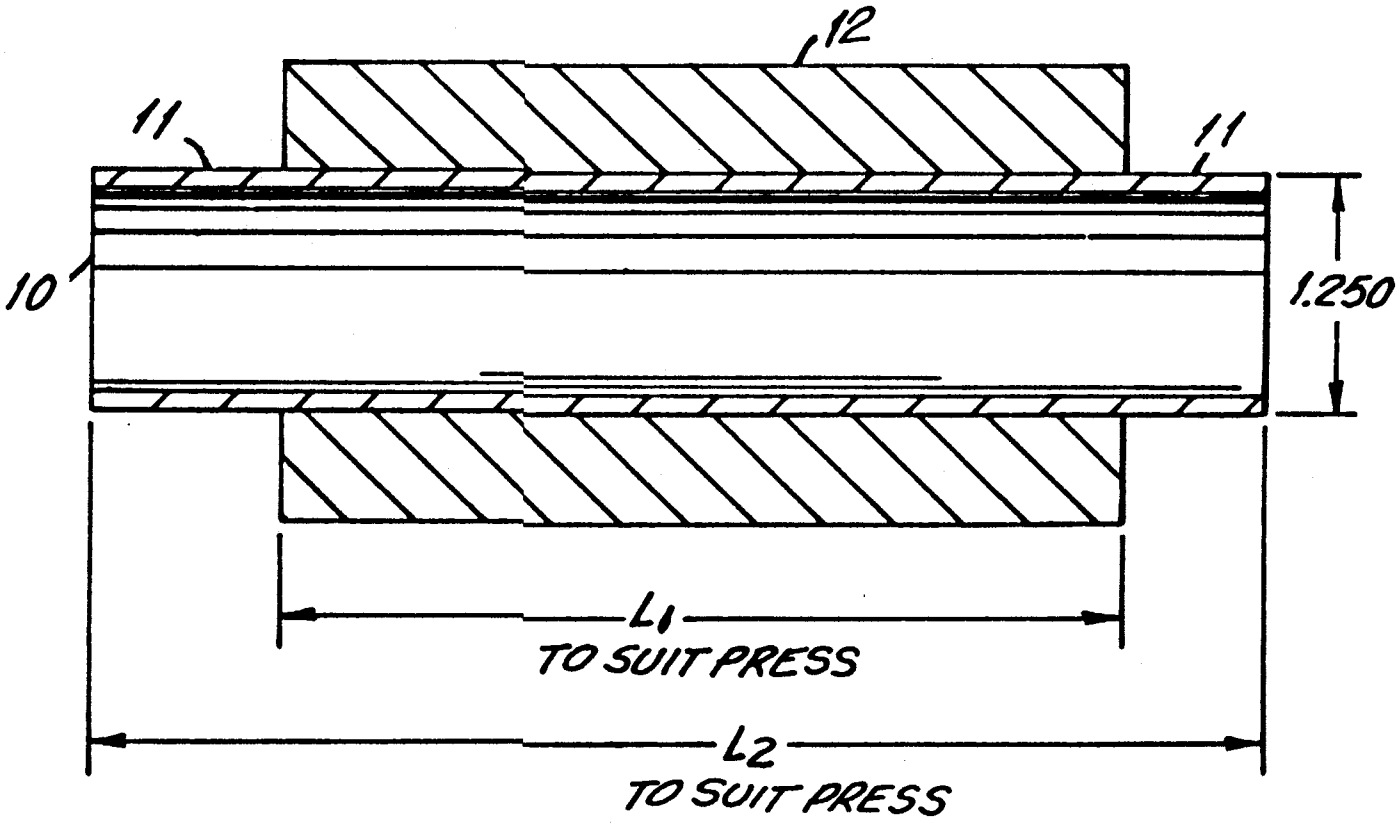
FIG. 2 is a perspective view of the cloth feed supply roll in accordance with the invention.

As embodied and illustrated in FIG. 2, the cloth roll is provided with a hollow tubular cylinder 10 on which is wound the cloth like material 12. The hollow tubular core is made of cardboard or paperboard or the like and has a thickness of about one-eighth of an inch to three-eights of an inch and generally about ¼ of an inch having a strength sufficient to support the cloth. The tubular core extends on each side beyond the width of the cloth forming extensions 11 of about one and one half inches. The outside diameter of the tubular member 10 is about one and one quarter inches. In the usual instance the core is about one and one-half inches in diameter.

The diameter of the conventional cloth roll including the cloth is usually about two and three quarters of an inch resulting in about 12 yards of cloth on the hollow cylindrical member. By contrast, with the present invention, the outside diameter of the cardboard tubular core is about one and one quarter inches, which provides about 20% more cloth which can be wound on the core 10.

An advantage to the use of an inner cardboard cylindrical hollow cardboard member is that when the cloth roll has been expended, the inner core can be discarded and trashed. In addition, unlike certain prior art practices, the core extension 11 can be used to support the supply roll and eliminate the need to remove a metal core member after the cloth has been expended. Thus the use of a cardboard hollow core extending beyond the width of the cloth eliminates the need for an adaptor member, i.e., the metal shaft member and permits the inner support core made of cardboard or the like to become a throw-away item at the time when the fabric has been depleted. It is noted that either thin metal core tubing material or plastic can be used.

In accordance with this invention means is provided for controlling the cleaning cloth removed from the cloth supply roll so as to prevent bunching of the cleaning cloth.

As embodied, this means includes spring means and brake means which becomes operational when the piston cylinder mechanisms are activated so as to rotate the cloth take-up roll which causes rotational movement of the cloth take-up roll as described in U.S. Pat. No. 4,344,361 to thereby remove cloth from the cloth supply roll.

The support frame has mounted therein an enlarged diameter socket member 21 having extending therefrom a reduced diameter socket extension shaft 23. The circumference of shaft 23 is surrounded by a bearing 123. The control means includes a coil spring 16. One end of the coil spring is attached to the extension 23 of the socket by any convenient means such as a screw means 18. The other end of the coil spring 16 is connected by any convenient means to fixed support 20 by any convenient means such as a screw means 22 which immovably fixes the position of the coil spring member 16. There is a segmental slot 24 in the annular socket support 21. Additionally mounted within the slot 24 is a pressure brake shoe 26 which is adapted to engage the supply roll shaft 10 so as to control feeding of the cloth. There is a pin 30 which limits the amount of movement of the socket 21 and limits the amount of tension force on the coil spring. The stop pin 30 is limited in its movement to stops 32, 32A. As shown in the first position, the pin 30 is in the "at rest" position. When the pin 30 moves to a position adjacent pin 32A, the spring 16 is loaded and in the advanced condition. This permits the spring 16 to retract slack in the cloth.

In accordance with the invention means is provided for bringing the pressure brake shoe into engagement with the supply roll shaft. As embodied, this means comprises a snap-ring 28 which may be "C" shaped. Extending from the pressure brake shoe 26 is an abutment 29 which may be in the form of a screw head. The restraining snap-ring 28 engages the abutment 29 connected to pressure brake shoe 26 to cause the pressure brake shoe 26 to be moved into pressure engagement with the inner core shaft 10. The pressure brake shoe prevents excessive feeding of the cleaning cloth.

Figure 4:
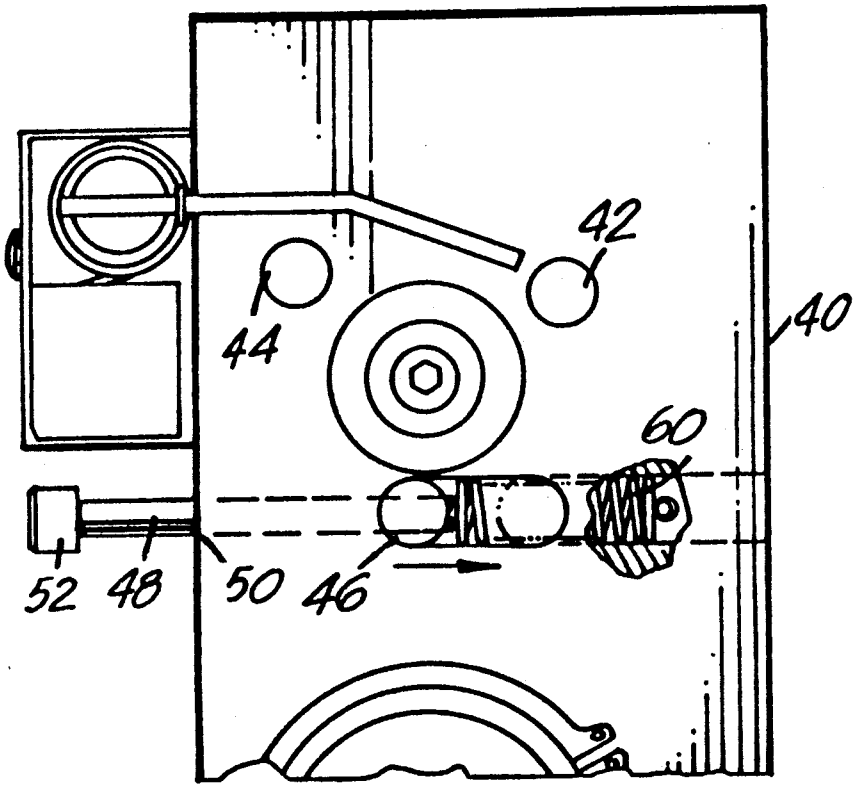
FIG. 4 is an elevation view of a portion of the invention.
Figure 6:
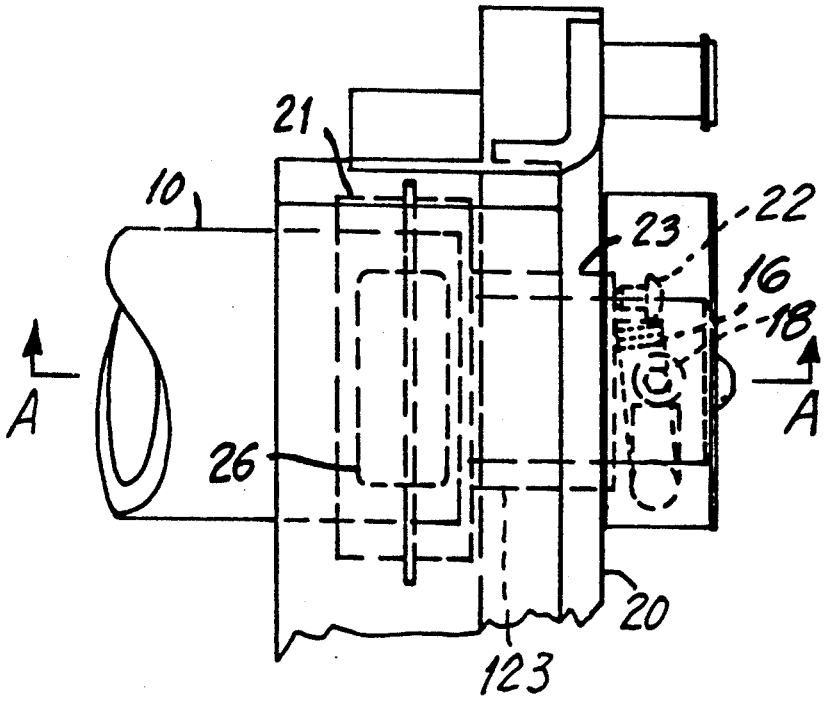
FIG. 6 is an elevation view of a portion of the invention.
Figure 7:
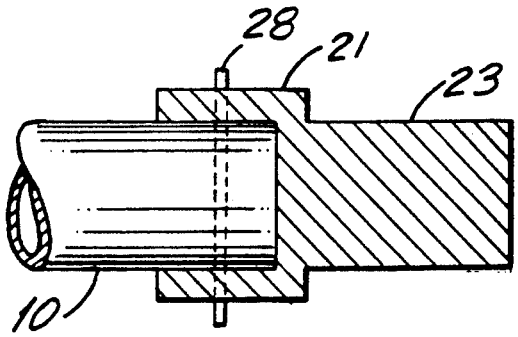
FIG. 7 shows a cross-section of a portion of FIG. 6.
Figure 8:
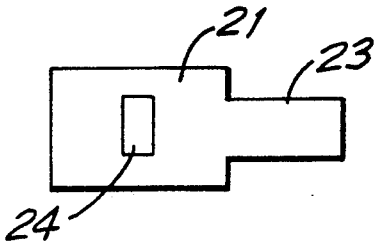
FIG. 8 shows a side-view of a portion of FIG. 6.
Figure 9:
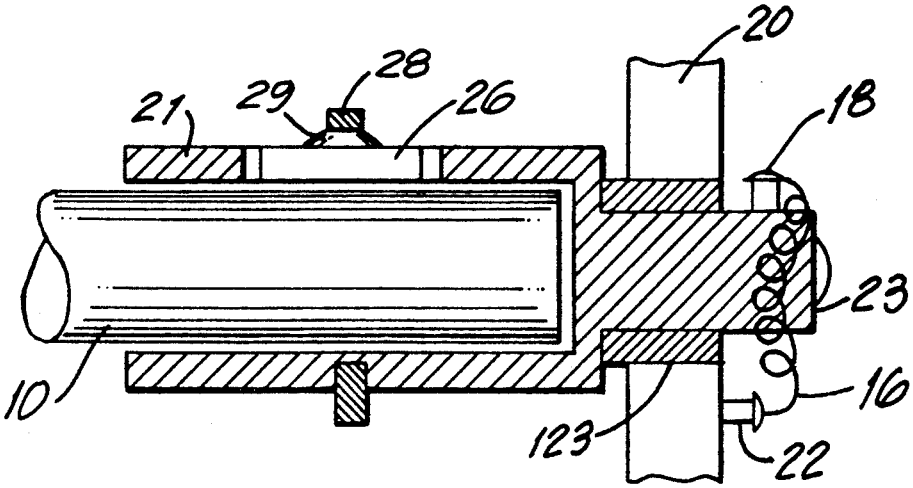
FIG. 9 shows a cross-section of view A—A of FIG. 6.

In accordance with this invention means is provided for rotatably supporting one end of the cloth supply roll support shaft in a manner which permits easy insertion and removability of the cloth roll assembly This means for rotatably supporting, as shown by FIG. 4, includes a support end plate 40. Extending from the support plate 40 are at least two stationary abutments which may be in the form of hardened steel pins 42, 44 spaced from a center point of the inner core axis by about 120°. The means for rotatably supporting also includes movable pin 46 which when in the operating position is spaced 120° from the adjacent fixed pins. The movable pin 46 is fixedly attached to a shaft 48 having an enlargement 52 at its other end for hand manipulation. The shaft 48 is mounted within a suitable opening 50 in the frame. There is a suitable spring means 60 attached to the movable pin 46 which biases the movable pin 46 towards its operative position where it holds the inner cardboard 10 core in rotative position.

The cloth roll tube is placed in an inoperative position between the fixed pins 42, 44 while the movable pin 46 has been moved to a non-operative position by pushing handle 52. After the cloth roll supply shaft has been placed in position between the two fixed pins, the movable pin 46 is released and the force by spring 60 moves pin 46 into a position whereby the cloth roll shaft is maintained in an operating position.

FIG. 3 also shows members 102. These are merely screws for assembly or disassembly with a device such as an Allen wrench.

Operation

In operation, the cloth supply roll is mounted so that one end is between the two fixed pins 42,44 and the movable pin 46 so as to permit rotation of the cloth roll shaft while preventing removal of the end of the cloth roll shaft. The other end of the cardboard hollow shaft is mounted in telescoping relationship within the socket member 21 with sufficient frictional engagement so that socket 21 and hollow cardboard insert member 10 are capable of moving together.

The cloth is advanced by the take up shaft 4 as a result of activation of the piston 53 and cylinder 51 combination, to pull cloth from the cloth supply roll 12. The operation of cylinder 51 and piston 53 to advance cloth is detailed in U.S. Pat. No. 4,344,361. This causes the cloth roll hollow cylindrical shaft 10 to rotate along with the metal socket member 21. The stop pin 30 on the socket member 21 rotates from the rest position 32 to the stop position 32A. This stretches or winds up the spring 16 until such time as the stop pin 30 engages the stop member 32A. The cloth then advances an incremental amount dependent upon the throw of the incremental feeding mechanism. At the end of the feeding stroke there is a tending of the fabric to relax which can cause sagging of the fabric. At this time, however, the spring 16 which has been stretched now rotates the cloth supply roll in the opposite direction so as to take up tension on any loose fabric which occurred during the feeding step. The friction of the brake shoe 26 is greater than the force created by the spring 16.

While specific embodiments of the present invention have been shown and described, it should be apparent that many modifications can be made thereto without departing from the spirit and scope of the invention. Accordingly, the present invention is not limited by the foregoing description, but is only defined by the scope of the claims appended hereto.

What is claimed is:

1. A cleaning cloth fabric supply system for use in a blanket cylinder cleaner mechanism of the type having a blanket cylinder, a cloth take-up roll, a mechanism for intermittently feeding cloth on the take-up roll from a cloth supply roll, and a mechanism for intermittently causing engagement of the cleaning cloth with the blanket cylinder comprising:

(a) a frame member, (b) cloth supply means having a expendable inner core member and adapted to have cleaning cloth of a predetermined width and length wound thereon;

(c) said inner core having a sufficient length to extend distances beyond each side of the width of the cleaning cloth;

(d) support means on said frame adapted to support each end of the inner core member in substantially parallel relationship to the blanket cylinder and the take-up roll;

(e) said support means on one side of said frame including a plurality of abutments extending from one side of said frame and adapted to support said inner core member to permit rotational movement of the core member, at least one of said abutments being movable to permit access to and from said frame member;

(f) control means on the other side of said frame for controlling rotation of said inner core member; said control means including a brake shoe means mounted for radial movement with respect to said inner core for limiting rotational movement of said inner core, and a spring means for exerting rotational tension upon said inner core during the intermittent feeding step, means for limiting the amount of spring load, said spring means causing a controlled amount of rewinding of cloth on the cloth supply roll so as to prevent bunching of the cleaning cloth, said spring means being functionally attached to said brake shoe means.

2. A cleaning cloth supply system as defined in claim 1 wherein said spring means includes a coil spring having one end which is fixed against movement and a second end which is fixed relative to the inner core member and adapted to rotate with said inner core member.

3. A cleaning cloth supply system as defined in claim 2 having a socket member operatively associated with said frame adapted to be removably associated with said inner core member, stop means connected to said socket member and adapted to move with said inner core member; said support means adjacent said socket member; said means for limiting the amount of spring load including a first stop member on said support means engageable with said stop means for defining a rest position for said inner core member, and a second stop member on said support means engageable with said stop means for defining an advanced limiting position for said inner core member whereby excessive cloth can be returned onto the cloth feed roll.

4. A cleaning cloth supply system as defined in claim 3 wherein said brake shoe is movably mounted on means within said socket member for mounting said brake shoe for radial movement with respect to said inner core member, spring means for urging said brake shoe into engagement with said inner core member so as to cause friction force greater than the force exerted by said coil spring.

5. A cleaning cloth supply system as defined in clam 1 wherein the inner core has a thickness between $\frac{1}{8}$ and $\frac{3}{8}$ of an inch.

6. A cleaning cloth supply system as defined in claim 1 wherein the cleaning cloth is made of paper consisting of:

| | |
|---|---|
| BASIC WEIGHT | 63# |
| TEAR-MACHINE DIRECTION | 120 GRAMS OF RESISTANCE |
| TEAR-CROSS DIRECTION | 140 GRAMS OF RESISTANCE |
| DRY TENSILE-MACHINE DIRECTION | 30 POUNDS PER INCH |
| DRY TENSILE-CROSS DIRECTION | 20 POUNDS PER INCH |
| WET TENSILE-MACHINE DIRECTION | 36.7 UNAGED POUNDS PER INCH |
| WET TENSILE-CROSS DIRECTION | 10.0 AGED POUNDS PER INCH |
| POROSITY PER 1000 CC | 8 SECONDS |
| WET STRENGTH PAREZ 631 AND KYMENE. | |

7. A cleaning cloth supply system as defined in claim 1 wherein said inner core is hollow.

8. A cleaning cloth supply system as defined in claim 7 wherein said inner core is made of cardboard.

9. A cleaning cloth supply system as defined in claim 7 wherein said inner core is made of metal tubing.

10. A cleaning cloth supply system as defined in claim 7 wherein said inner core is made of plastic.

11. A cleaning cloth fabric supply system for use in a blanket cylinder cleaner mechanism of the type having a blanket cylinder, a cloth take-up roll, a mechanism for intermittently feeding cloth on the take-up roll from a cloth supply roll, and a mechanism for intermittently causing engagement of the cleaning cloth with the blanket cylinder comprising:

(a) a frame member;

(b) cloth supply means having an expendable inner core member and adapted to have cleaning cloth of a predetermined width and length wound thereon;

(c) said inner core having a sufficient length to extend distances beyond each side of the width of the cleaning cloth;

(d) support means on said frame adapted to support each end of the inner core member in substantially parallel relationship to the blanket cylinder and the take-up roll;

(e) said support means on one side of said frame including a plurality of abutments extending from one side of said frame and adapted to support said inner core member to permit rotational movement of the core member, at least one of said abutments being movable to permit access to and from said frame member;

(f) control means on the other side of said frame for controlling rotation of said inner core member; said control means including a brake shoe means for limiting rotational movement of said inner core, and a spring means for exerting rotational tension upon said inner core during the intermittent feeding step, means for limiting the amount of spring load, said spring means causing a controlled amount of rewinding of cloth on the cloth supply roll so as to prevent bunching of the cleaning cloth, said spring means being functionally attached to said brake shoe means; and further having (g) a hollow enlarged socket member adapted to receive an end of said inner core, said socket member having a reduced diameter shaft extension.

12. A cleaning cloth supply system as defined in claim 11 wherein a cloth roll extension is mounted within said enlarged socket member and said brake shoe means is mounted within said socket.

13. A cleaning cloth supply system as defined in claim 12 wherein one end of said spring means is attached to said shaft extension and said means for limiting the amount of spring load includes a stop pin which is attached to said shaft extension.

* * * * *